United States Patent [19]

Zebuhr et al.

[11] 4,172,495

[45] Oct. 30, 1979

[54] SLURRY COOLING OF HELMETS

[75] Inventors: William H. Zebuhr; Kenneth E. Mayo; Charles R. Fink, all of Nashua, N.H.

[73] Assignee: Energy Systems Corporation, Nashua, N.H.

[21] Appl. No.: 821,507

[22] Filed: Aug. 3, 1977

[51] Int. Cl.[2] ..... F28F 7/00

[52] U.S. Cl. ..... 165/46; 128/400; 128/402; 2/413; 62/259; 150/2.3

[58] Field of Search ..... 165/46; 62/259, 293, 62/259 B; 2/81, 82, 410, 411, 413, 171.2; 150/2.3; 128/400, 402

[56] References Cited

U.S. PATENT DOCUMENTS

| | | | |
|---|---|---|---|
| 1,627,523 | 5/1927 | Morris | 165/46 |
| 3,570,264 | 3/1971 | Curtis | 165/46 |
| 3,744,555 | 7/1973 | Fletcher et al. | 165/46 |
| 3,908,655 | 9/1975 | Lund | 128/402 |
| 4,010,795 | 3/1977 | Stenberg | 165/46 |

*Primary Examiner*—Samuel Scott
*Assistant Examiner*—Theophil W. Streule, Jr.

[57] ABSTRACT

The invention relates to a slurry-cooled helmet and to a head-cooling system. The helmet includes a hollow shell within which is positioned a plurality of tubes connected between an inlet and a discharge manifold. The manifolds are respectively connected to inlet and outlet means in the helmet shell.

21 Claims, 3 Drawing Figures

SLURRY COOLING OF HELMETS

BACKGROUND OF THE INVENTION

The present invention relates to a slurry-cooled helmet and to a head-cooling system of which such a helmet is an integral component.

Helmets are worn by competitors in various forms of athletic contents such as football and hockey. They are also worn for protection by individuals engaged in the construction field. During such athletic competition or construction work considerable body heat is generated which reflects itself in discomfort to the wearer of the helmet and not uncommonly results in a physical condition, sometimes fatal, known as hyperthermia. The performance of such activities in an environment where elevated temperatures prevail is known to cause or aggravate such condition.

One of the purposes of this invention is to provide a helmet which can be worn by an athlete or by an individual under circumstances where there is risk of developing the aforementioned condition whereby such risk is minimized or entirely obviated. The invention also is intended to provide a system by means of which the helmet can be periodically recharged with coolant while being taken out of service for minimal periods of time.

SUMMARY OF THE INVENTION

It is one object of the invention to provide a slurry-cooled helmet which can be worn to conrol body temperature under such conditions of activity and/or prevailing ambient temperature which would otherwise cause discomfort and/or illness to the individual wearing a helmet at such times.

It is another object of the invention to provide a slurry-cooled helmet of the character described which can periodically be recharged with fresh slurry while requiring removal of the helmet from service for minimal periods of time.

It is still another object of the invention to provide a head-cooling system whereby a slurry-cooled helmet of the character described can be periodically withdrawn from service for minimal periods of time to be recharged with fresh slurry to thereby maximize the cooling efficiency of the helmet.

It is a further object of the invention to provide a slurry-cooled helmet which provides enhanced impact absorption by virtue of the cooling tubes.

Other objects and advantages of the invention will become readily apparent to persons versed in the art from the following description of the invention.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
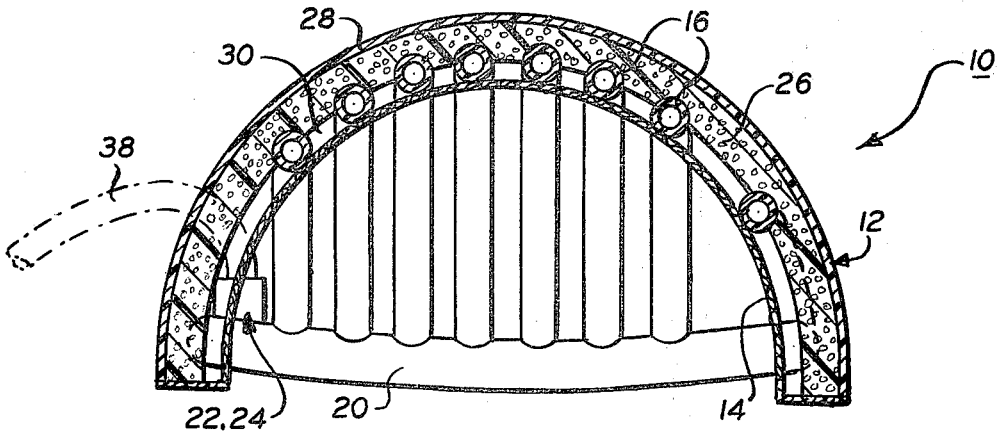
FIG. 1 is a front elevational view, partly in cross-section, of the upper portion of a helmet embodying the features of the invention.
Figure 2:
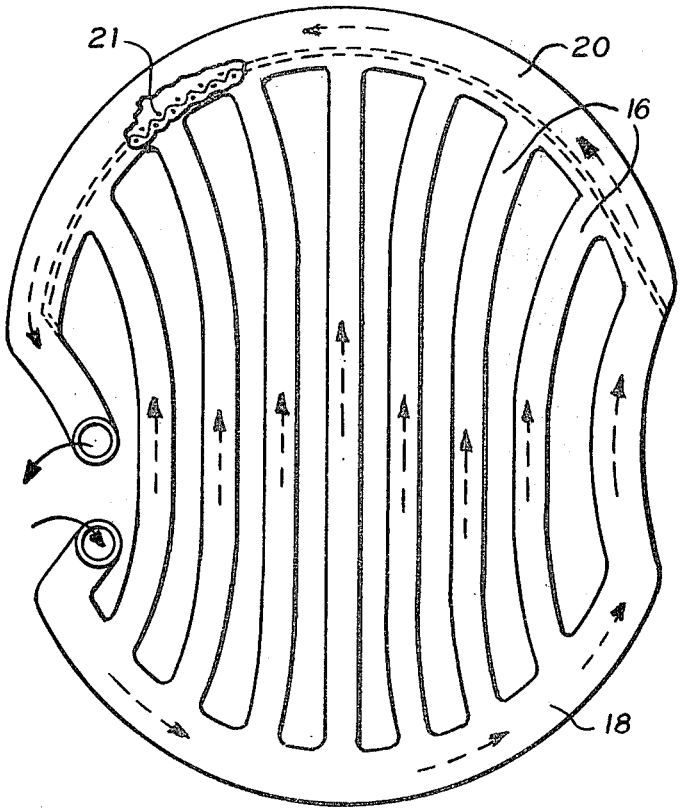
FIG. 2 is a plan view, partially broken away, of the network of cooling tubes in the helmet of FIG. 1.

Referring to the drawings there is shown in FIGS. 1 and 2 a helmet which is constructed in accordance with a preferred embodiment of the invention. The helmet 10 depicted comprises a hollow shell 12 which includes an inner wall or lining 14 that is contoured generally so as to facilitate mounting upon the head of a person. The helmet shell is desirably fabricated of a high impact strength synthetic plastics material of which there are many that are commercially available. It will be appreciated, however, that the shell may be constructed of metal, such as a metal stamping, or of a leather or leather-like material which is reinforced so as to provide the desired rigidity. The shell may be dome-like in configuration as is customary; however, the specific shape is not critical to the invention.

Positioned within the hollow shell is a network of tubes 16, preferably made of a flexible material for reasons which will become apparent. The tubes 16 extend throughout a substantial portion of the hollow region of the shell and desirably extend in a direction longitudinally of the helmet from front to rear. Inlet and discharge manifolds 18, 20 are positioned within the shell and desirably extend transversely of the general direction of tubes 16. As shown most clearly in FIG. 2, since the helmet is generally arcuate in configuration the manifolds are similarly configured. Inlet manifold 18 is connected across one end of each of the tubes 16 and discharge manifold 20 is connected across the other end of the tubes. In the preferred form the manifolds are fabricated of the same material used to form the tubes. Thus, the manifolds are also preferably flexible.

A filter 21 is provided within the shell adjacent the intended downstream terminus of each of tubes 16 so as to inhibit the discharge of frozen solids into the discharge manifold and permit liquid only to pass therethrough. As shown in FIG. 2 such filter may take the form of a filter screen which extends across the discharge end of all of tubes 16.

Inlet and outlet means 22, 24 are provided in the helmet for respectively admitting a slurry of frozen solids to and withdrawing liquid which is substantially free of such solids from the shell. Desirably there is no interconnection between the inlet and discharge manifolds at their respective inlet and discharge ends, each of such ends terminating in a fitting adapted to receive the end of a hose or conduit, or an end coupling thereon, to connect the manifolds with a slurry generator to be described. Thus, when the frozen slurry initially introduced into the helmet shell via the inlet manifold has melted and is no longer effective in maintenance of the desired body temperature of the wearer of the helmet the inlet and outlet means of the shell are connected to the hoses or conduits leading to the slurry generator and the shell is recharged with a fresh supply of slurry concomitantly with the withdrawal of melted coolant for recycle to the slurry generator.

The helmet is preferably provided with an impact absorbing material 26 which may be positioned within the shell so as to occupy at least the void region between the tubes and manifolds and the exterior wall 28 thereof. The impact absorbing material is desirably a foam material such as polystyrofoam. Such impact absorbing material preferably also exhibits thermal insulation characteristics so as to assist in maintaining the coolant slurry in at least a semi-frozen state for substantial periods of time. Provision of such an impact absorbing material is particularly advantageous when the helmet is to be worn in a cool environment. It will be appreciated that the tubes, in being flexible, contribute to the capacity of the shell to absorb impact since the slurry, even when the solids therein are completely frozen, do not constitute a totally solid unyielding mass. The tubes thus have the capacity to flatten under the impact and deform into the voids therebetween. If desired one or more relief valves (not shown) may be incorporated in the system of tubes and manifolds so as to permit the discharge of some of the slurry under a predetermined pressure. Alternatively, the tubes may be constructed of a material or of a wall thickness which will insure bursting when a predetermined pressure is exceeded.

It will also be undertstood that the impact absorbing material may be omitted altogether and the network of tubes and manifolds relied upon to provide the desired impact absorption. For optimum comfort in environments of elevated temperatures it is desirable that air spaces be allowed between the head of the wearer and the impact absorbing material within the shell. Thus, as can be seen in FIG. 1, the region 30 of the shell adjacent the inner wall thereof is devoid of impact absorbing material. The impact absorbing material may be a unitary member, such as produced by a molding procedure, which enables the material to be readily inserted into or withdrawn from the shell as may be desired depending principally upon the environmental conditions in which the helmet is to be worn.

Some adjustment in the size of the shell so as to accommodate a range of head sizes and shapes can be obtained by bending and/or spreading of the tubes which is, of course, facilitated by fabrication of the tubes from a flexible material.

The invention, as previously stated, also provides a head-cooling system whereby the helmet described may be periodically recharged with a fresh supply of a coolant slurry. Such a system is shown diagrammatically in FIG. 3. As shown, slurry-producing means such as a slurry generator 32 is provided. The slurry generator should have sufficient refrigerating capacity to generate frozen particles from a selected liquid and to maintain the thus produced slurry at a temperature approximating the freezing temperature of the liquid. Slurry or ice generators are known in the art. Therefore, it is not seen necessary to encumber the present specification with the constructional details of such apparatus. In the preferred embodiment of the invention an ice water slurry is produced. The slurry could consist of crushed ice in water; however, this is generally less desirable than a slurry in which the frozen solids are substantially uniform particles in water. By providing a slurry which the frozen particles are relatively uniform pumping of the slurry to the helmet is facilitated and a greater ratio of ice to water may be transported. It will, of course, be understood that the capacity of the slurry generator may be varied depending upon the particular liquid coolant to be employed in production of the slurry.

Figure 3:
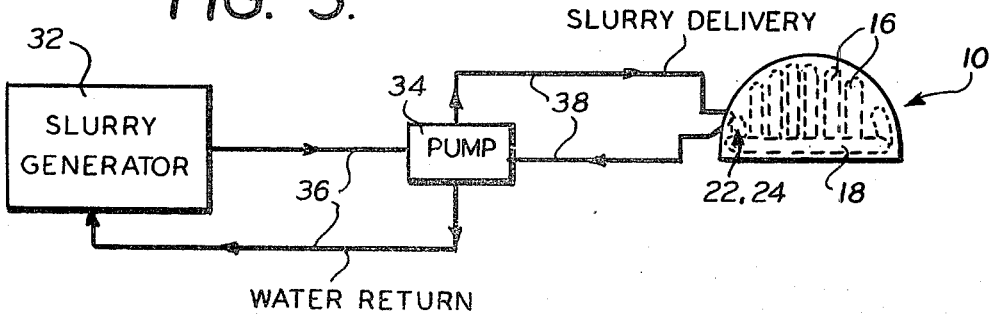
FIG. 3 is a schematic diagram of the head-cooling system of the invention during recharging of a helmet as shown in FIG. 1.

As depicted in FIG. 3, a pump 34 is connected to the slurry generator by means of tubes or conduits 36 so as to pump a slurry of the frozen solids from the generator and to return to such generator a stream of liquid which is substantially free of frozen solids. The pump is provided with tubes or conduits 38 adapted for connection to the inlet and outlet means of the helmet so as to feed a slurry of frozen solids to such inlet means, and thereby into the inlet manifold of the helmet, and to withdraw liquid substantially free of frozen solids from the helmet outlet means for recycling to the slurry generator.

In charging of the helmet the slurry is pumped thereto by means of pump 34 and the tubes or conduits 36, 38. The ice slurry enters the inlet manifold and is caused to flow through tubes 16. The ice particles are prevented by filter 21 from flowing into the discharge manifold, the liquid flowing through the filter into the discharge manifold to the outlet means of the helmet from whence it is returned to the slurry generator for generation of ice particles. It is desirable to withdraw as much liquid as possible after filling of the helmet shell so as to reduce the helmet weight.

The system described thus permits the wearer of the helmet to benefit from the cooling effect of the ice slurry therewithin for periods of time ranging from one-half hour to an hour under normal circumstances without the need for any attachment to the helmet to maintain the effectiveness of the network of cooling tubes. As stated earlier, periodically it will become necessary to recharge the helmet with a fresh supply of the coolant slurry. However, such recharging requires less than one minute and the helmet need not be removed during such recharging.

Various modifications and changes have been suggested in the foregoing description. Others will be obvious to those skilled in this art. Consequently, it is intended that the present disclosure be illustrative only and not limiting of the scope of the invention.

What is claimed:

1. A frozen packed helmet comprising:

a hollow shell including an inner wall contoured generally to be mounted on the head of a person;

a plurality of tubes, positioned within said shell so as to extend substantially parallel to each other through a substantial portion thereof;

an inlet manifold positioned within said shell connected to one end of each of said tubes;

a discharge manifold positioned within said shell connected to the other end of each of said tubes;

inlet and outlet means carried by said shell connected respectively with said inlet and discharge manifolds for selectively admitting a coolant slurry comprising frozen solids and a liquid carrier to said helmet and for withdrawing liquid therefrom;

filter means provided adjacent the connection between each of said tubes and said discharge manifold for preventing the discharge of frozen solids together with liquid whereby said tubes may be filled with said frozen solids initially void of the liquid carrier, and means for closing said inlet and outlet means to trap said frozen solids therein.

2. The helmet according to claim 1, wherein said filter means comprises a filter screen positioned across all of said tubes.

3. The helmet according to claim 1, wherein said inlet and discharge manifolds are positioned so as to extend generally transversely of said shell and said tubes connected therebetween extend generally longitudinally of said shell.

4. The helmet according to claim 1, wherein said tubes and said manifolds are formed of a flexible material.

5. The helmet according to claim 1, wherein an impact absorbing material is positioned within said shell so as to occupy at least the space between said tubes and manifolds and the exterior wall thereof.

6. The helmet according to claim 5, wherein said impact absorbing material is a foam material.

7. The helmet according to claim 6, wherein said foam material is polystyrofoam.

8. The helmet according to claim 5, wherein the region within said shell adjacent said inner wall thereof is free of said impact absorbing material.

9. The helmet according to claim 1, wherein said inlet and discharge manifolds are connected at one end thereof, the other ends of said inlet and discharge manifolds being respectively connected to said inlet and outlet means of the shell.

10. A head-cooling system comprising:

a helmet having a hollow shell and including an inner wall contoured generally to be mounted on the head of a person;

a plurality of tubes positioned within said shell so as to extend substantially parallel to each other through a substantial portion thereof;

an inlet manifold positioned within said shell connected to one end of each of said tubes;

a discharge manifold positioned within said shell connected to the other end of each of said tubes;

inlet and outlet means carried by said shell connected respectively with said inlet and discharge manifolds;

means for producing a slurry of frozen solids and means for transporting said slurry to the inlet means of said helmet shell and for withdrawing liquid substantially free of frozen solids from the outlet means of said helmet shell and for returning said liquid to said slurry-producing means; and, filter means provided adjacent the connection between each of said tubes and said discharge manifold for preventing the discharge of frozen solids together with liquid.

11. The head-cooling system according to claim 10, wherein said slurry-producing means comprises means for generating frozen particles from a liquid and for maintaining the thus produced slurry at a temperature approximating the freezing temperature for the liquid.

12. The head-cooling system according to claim 10, including pump means connected to said slurry-producing means so as to pump a slurry of frozen solids therefrom and to pump liquid substantially free of frozen solids thereto, said pump means being adapted to be connected to the inlet and outlet means of said helmet shell so as to feed a slurry of frozen solids to said inlet means and to withdraw liquid substantially free of frozen solids from said outlet means.

13. The head-cooling system according to claim 10, wherein said slurry-producing means is adapted to produce a slurry of ice particles in water.

14. The head-cooling system according to claim 10, wherein said filter means comprises a filter screen positioned across all of said tubes.

15. The head-cooling system according to claim 10, wherein said inlet and discharge manifolds are positioned so as to extend generally transversely of said shell and said tubes connected therebetween extend generally longitudinally of said shell.

16. The head-cooling system according to claim 10, wherein said tubes and said manifolds are formed of a flexible material.

17. The head-cooling system according to claim 10, wherein an impact absorbing material is positioned within said shell so as to occupy at least the space between said tubes and manifolds and the exterior wall thereof.

18. The head-cooling system according to claim 17, wherein said impact absorbing material is a foam material.

19. The head-cooling system according to claim 18, wherein said foam material is polystyrofoam.

20. The head-cooling system according to claim 17, wherein the region within said shell adjacent said inner wall thereof is free of said impact absorbing material.

21. The head-cooling system according to claim 10, wherein said inlet and discharge manifolds are connected at one end thereof, the other ends of said inlet and discharge manifolds being respectively connected to said inlet and outlet means of the shell.

* * * * *